United States Patent [19]

Efird

[11] Patent Number: 4,830,211

[45] Date of Patent: May 16, 1989

[54] COLLAPSIBLE MOVING AND STORAGE CONTAINER

[76] Inventor: Alex M. Efird, 1215 N. 23 St., P.O. Box 419, Wilmington, N.C. 28405

[21] Appl. No.: 128,870

[22] Filed: Dec. 4, 1987

[51] Int. Cl.[4] ..... B65D 7/24

[52] U.S. Cl. ..... 220/4 F; 206/600

[58] Field of Search ..... 206/600; 220/4 F, 1.5, 220/80, 72.1, 76, 84

[56] References Cited

U.S. PATENT DOCUMENTS

| | | | |
|---|---|---|---|
| 3,266,656 | 8/1966 | Kridle | 220/4 F |
| 4,171,059 | 10/1979 | Heller et al. | 220/4 F |
| 4,212,406 | 7/1980 | Mittelmann | 220/4 F |
| 4,349,117 | 9/1982 | Bain et al. | 220/4 F |
| 4,422,558 | 12/1983 | Mittelmann et al. | 220/4 F |
| 4,625,880 | 12/1986 | Pym | 220/4 F |
| 4,673,087 | 6/1987 | Webb | 220/4 F |

*Primary Examiner*—Joseph Man-Fu Moy

*Attorney, Agent, or Firm*—Rhodes, Coats & Bennett

[57] ABSTRACT

The present invention entails a collapsible moving and storage container for holding household furnishings and other articles typically moved or stored. A series of six panel assemblies are designed to cooperate and join together to form a container of relatively light weight but which forms an envelope of substantial space when the container assumes any erect posture. The container is specifically designed to be compatible with a highly automated and controlled container handling system that would move and direct a container from the warehouse to a truck and finally to a household and vice versa.

21 Claims, 12 Drawing Sheets

COLLAPSIBLE MOVING AND STORAGE CONTAINER

FIELD OF INVENTION

The present invention relates to moving and storage containers of the type utilized to hold and store household furnishings and the like, and more particularly, to a collapsible moving and storage container.

BACKGROUND OF THE INVENTION

The moving and storage of furniture and household articles form a tremendous industry as there are thousands of families moving from place to place each year. It is not uncommon to hear families complaining about various experiences they have encountered in transferring their households from one location to another. The concerns raised by these individuals range from complaints that the process is slow and inefficient to complaints about valuables, that are not replaceable, that were lost or stolen in the process. These same problems are present when families have their furniture and other household items stored.

The moving and storage industry typically uses wooden type containers to store household goods and in some cases the same wooden containers are used in transporting these household goods from one location to another. A strong case can be made that these wooden containers contribute significantly to the above problems. They are heavy and quite awkward to handle. One of the principal problems with conventional wood containers used to hold and store furniture, is that the containers are not designed for or compatible with a highly effective and efficient handling system. To put it in simple terms, the handling, moving, and storage of household items is still a very laborious and time consuming chore.

There has been and continues to be a need for a light weight very efficient moving and storage container that is designed to be compatible with a highly efficient container transport system. Further, there has been and continues to be a need for a container that is specifically designed to break down and when broken down to assume a relatively small package that can be easily stored and transported. In addition, there is a need for such a container that can be secured in an open fashion such that the customer can have reasonable confidence and assurance that the goods within the container have not been taken or tampered with.

SUMMARY AND OBJECT OF THE INVENTION

The present invention relates to a collapsible moving and storage container that can be easily and conveniently erected and transformed into a collapsed condition for convenient storage or handling.

The collapsible container of the present invention comprises six detachable panel assemblies, with each panel assembly being constructed of a light weight metal such as aluminum and designed to receive a series of closing panels. Each respective panel assembly includes a special design connecting edge that enables each panel assembly to be connected along four edges to a series of other joining panels.

In the present disclosure the connecting joints are formed by a perimeter extrusion and wherein the ends, roof, and side panels include an open metal frame construction and is designed to receive plywood or filler panel in certain openings.

Also, the present invention is provided with a panel assembly that is designed to be sealed in such a fashion that the customer is reasonably assured that his household goods will be protected from thievery or pilfering.

It is therefore an object of the present invention to provide a collapsible moving and storage container.

Another object of the present invention is to provide a moving and storage container that can be erected and collapsed relatively easy.

Still a further object of the present invention resides in the provision of a collapsible container of the character referred to above that is specifically designed when collapsed to stack and be secured into a compact package.

It is also an object of the present invention to provide a collapsible moving and storage container of the character referred to above that utilizes a series of specially extruded joints that enable the various panel assemblies comprising the container to be easily and conveniently connected and disconnected with respect to each other.

It is also an object of the present invention to provide a collapsible container of the character referred to above wherein the connecting joints are designed to give strength and rigidity to the entire container as a whole when the same assumes an erect posture.

Another object of the present invention resides in the provision of a collapsible moving and storage container of the character referred to above that is of a relatively lightweight construction and which can be easily manufactured and which is relatively inexpensive.

Another object of the present invention resides in the provision of a collapsible container of the character referred to above that is constructed of a series of panel assemblies wherein each panel assembly includes a lightweight metal frame that defines a series of open areas therearound which are filled by filler panels such as plywood.

It is also an object of the present invention to provide a collapsible moving and storage container of the character referred to above that is of a generally open construction that gives suitable breathing capability for climate protection of the goods contained therein.

Another object of the present invention resides in the provision of a collapsible container of the character referred to above that is designed to allow for the convenient tie down of relatively expensive items contained or stored within the container.

Still a further object of the present invention resides in the provision of a collapsible container of the character referred to above that is of a design that allows certain panel assemblies of the container to be economically replaced.

Another object of the present invention resides in the provision of a collapsible moving and storage container that by its design lends itself to integration and use within a highly efficient container handling system.

Another object of the present invention is to provide a collapsible container of the character referred to above that is of a relatively lightweight construction but which if designed such that a plurality of the containers can be stacked one upon the other.

Still a further object of the present invention resides in the provision of a collapsible container for housing and transporting household furnishings and articles which is designed to be an integral unit of a complete automatic transport and handling system capable of moving the container from a warehouse to a truck and from the truck to a residence and vice versa.

Finally, an object of the present invention resides in the provision of a collapsible moving and storage container that is designed to be highly functional, economical, and effective.

It is also an object of the present invention to provide a container comprised of a series of detachable panel assemblies wherein the respective joints formed by the panel assemblies about the inside of the container are flush and smooth throughout.

Other objects and advantages of the present invention will become apparent and obvious from a study of the following description and the accompanying drawings which are merely illustrative of such invention.

Figure 1:
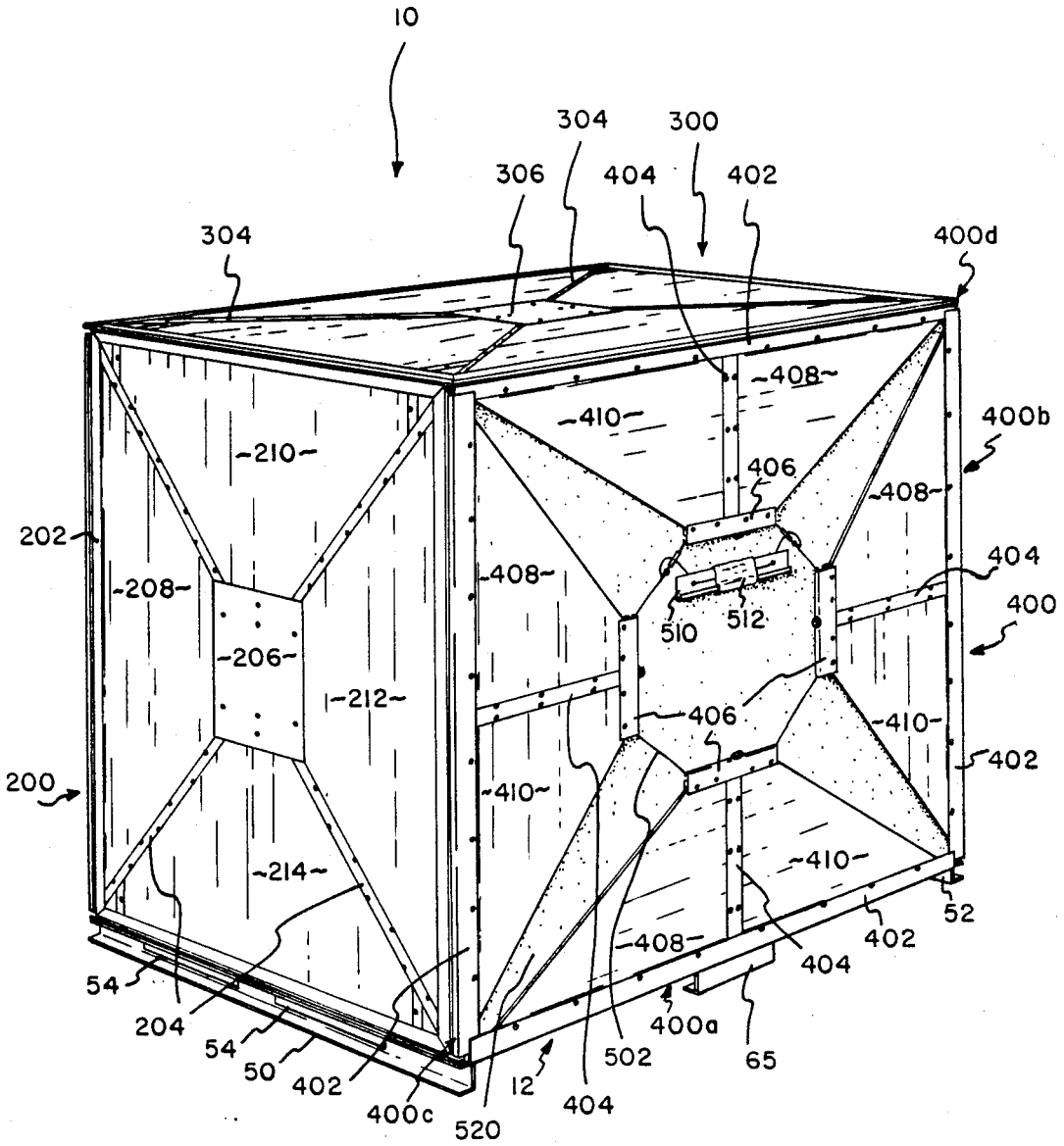
FIG. 1 is a perspective view of the collapsible moving and storage container of the present invention.

FIGS. **23*a*–23*i* are a sequence of schematic illustrations showing how the multiside container of the present invention is erected to form the structure shown in FIG. 1**.

Figure 24:
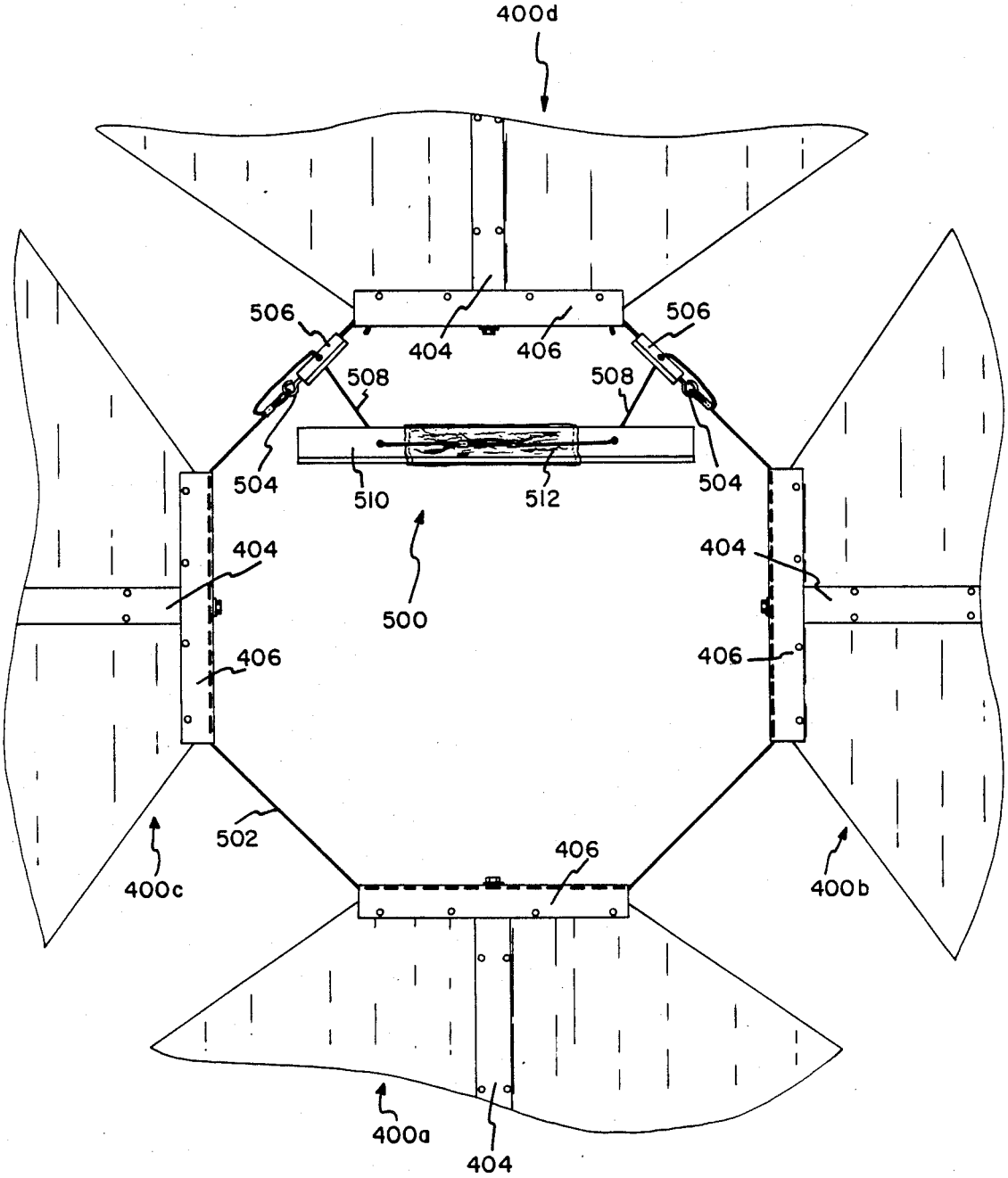

FIG. 24 is a fragmentary side elevational view of a series of sub-panel assemblies which particularly shows the cable assembly of the present invention that effectively secures and seals a side portion of the container.

DETAILED DESCRIPTION OF THE INVENTION

With further reference to the drawings, the collapsible moving and storage container of the present invention is shown therein and indicated generally by the numeral 10. Moving and storage container 10 comprises six separate and independent panel assemblies that are readily attachable and detachable with respect to each other. For purposes of reference these six separate panel assemblies are referred to as a bottom pallet base assembly 12, a pair of end panel assemblies 200, a pair of side or front and back panel assemblies 16, and a roof or top panel assembly 300.

As will be more fully understood and appreciated from subsequent portions of this disclosure, these respective panel assemblies can be coupled with each other to form an envelope of space that actually forms the moving and storage container of the present invention. As will be seen, the respective panel assemblies referred to above can be easily and conveniently attached and detached with respect to each other to form a strong and sturdy enclosure for supporting and enclosing furniture and other articles and structures and at the same time the entire container can be disassembled or broken down into relatively thin panels for convenient storage or transport.

Figure 2:
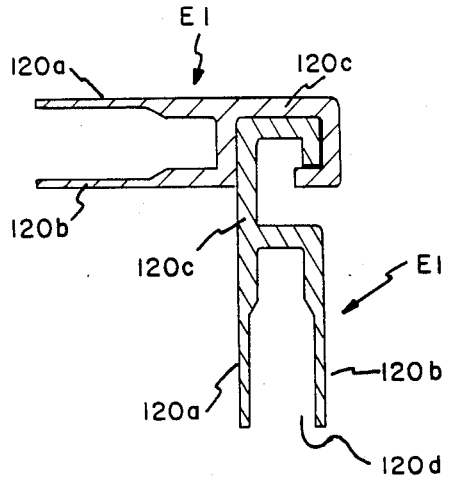
FIG. 2 is a cross sectional view illustrating a first type of connecting extrusion utilized by the container of the present invention, with this figure showing two of such extrusions coupled together.
Figure 3:
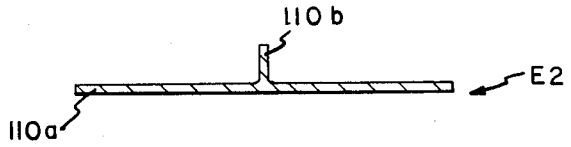
FIG. 3 is a cross sectional view showing a second type of extrusion that is utilized by the container of the present invention.
Figure 4:
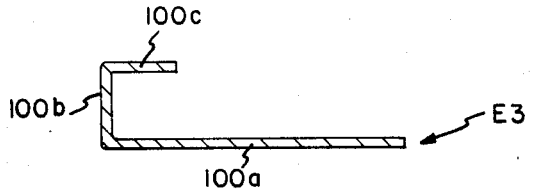
FIG. 4 illustrates a third type of extrusion designed to mate and couple with the extrusion type shown in FIG. 2.
Figure 5:
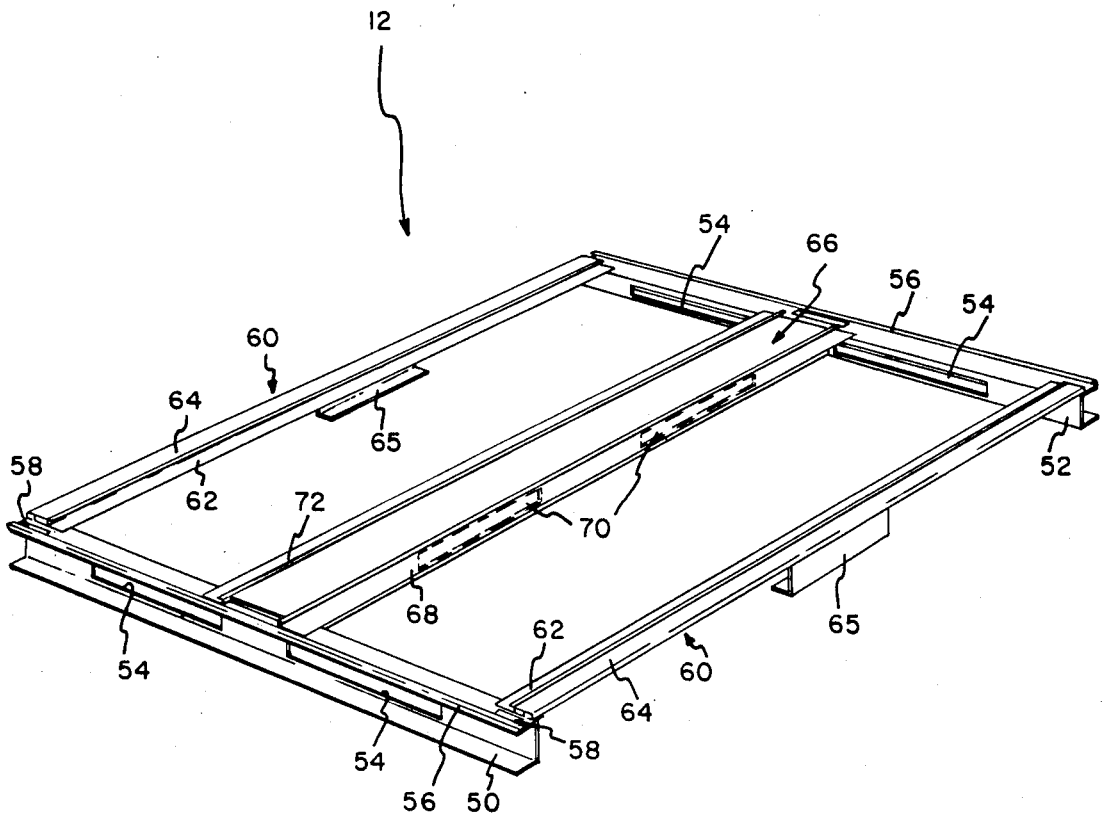
FIG. 5 is a perspective view of the bottom panel assembly of the container with its two filler sections being removed to better illustrate the structure thereof.
Figure 6:
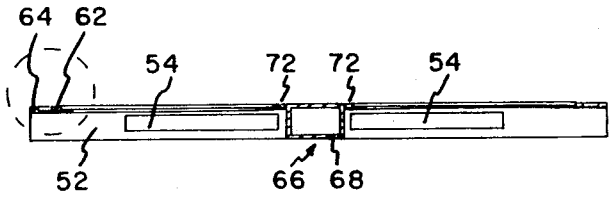
FIG. 6 is a cross sectional view taken along the lines 6—6 in FIG. 8.
Figure 7:
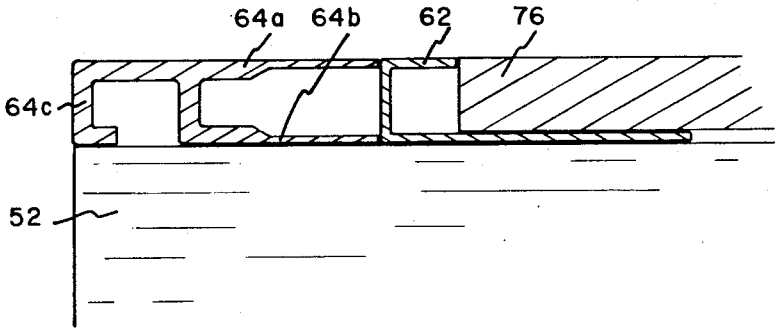
FIG. 7 is an enlarged fragmentary sectional view illustrating the dotted encircled area of FIG. 6.

In the design disclosed herein, the present invention entails three basic extrusions that are preferably formed from a lightweight material such as aluminum. To facilitate the understanding of the design of the present moving and storage container 10 a discussion of each of these extrusions will first be discussed. Referring to FIGS. 2–4, these three extrusions are shown therein and indicated generally by E1, E2, and E3. First, referring to extrusion El, it is seen that the same includes a pair of spaced apart legs **120*a* and 120*b* that define a panel receiving opening 120*d* therebetween. Extending from legs 120*a* and 120*b* is a coupling head 120*c***.

Extrusion E2 includes a flat bar or plate **110*a* with a midridge 100*b*** extending perpendicular thereto.

Extrusion E3 is of a generally L-shape and includes a leg **100*a*, a base 100*b*, and an upturned flange 100*c***.

Extrusions E1, E2, and E3 are designed to form selected portions of the respective panel assemblies referred to above which form the moving and storage container 10 of the present invention. As will be more fully appreciated from subsequent portions of this disclosure, selected extrusions are designed to mate and couple with each other in a detachable relationship. For example, the head portion **120*c* of extrusion E1 is designed to mate with the L-shaped configuration of extrusion E3. In addition, in various locations two of the containers panel assemblies will mate together and be coupled by the interconnection of two held portions 120***c* of the same extrusion, extrusion E1 (See FIG. 2).

Now turning to the respective panel assemblies forming the collapsible moving and storage container 10 of the present invention. First, a discussion will be directed at the bottom pallet base assembly indicated generally by the numeral 12. See FIGS. 5–8. Pallet base assembly 12 comprises a pair of end base channels 50 and 52. Formed in each base channel is a pair of fork lift openings 54. Secured by weldment or other suitable means to the upper surface of each base channel 50 and 52 is a retaining extrusion 56 of the E3 type. A series of strap openings 58 are formed through the retaining extrusion 56 and its supporting end channel 50 or 52. Respective strap openings 58 enable furniture or other articles carried within the moving and storage container 10 to be strapped and secured therein.

Secured transversely between the end base channels 50 and 52 is a pair of forward and rear transverse members, each indicated generally by tee numeral 60. Each transverse member 60 includes an inwardly facing ledge 62 that is of the E3 extrusion type. Secured to the E3 extrusion ledge 62 and extending outwardly therefrom is a coupling extension 64 which is of the E1 extrusion type. As seen in the drawing, coupling extrusion 64 includes a pair of legs 64*a* and 64*b* and a connecting head 64*c*.

Secured to the underside of each forward and rear transverse member 60 is a foot support 65.

Extending midway between the forward and rear transverse members 60 is a central support trunk 66 that is likewise secured between end base channels 50 and 52. Central support trunk 66 includes an elongated box frame 68 that includes a pair of transverse forklift openings 70 formed therein. Secured about each side to box frame 68 is a pair of inner panel supports 72 that project inwardly from opposite sides of box frame 68. Each inner panel support 72 is of the E3 extrusion type.

Figure 8:
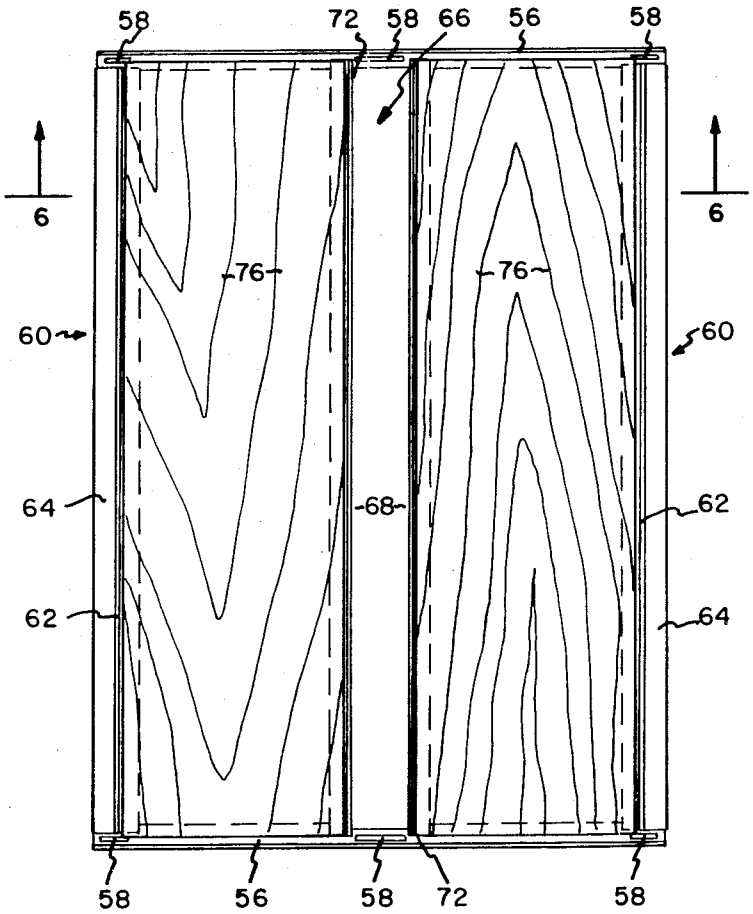
FIG. 8 is a top plan view of the bottom pallet assembly of the collapsible container of the present invention.

Therefore, there is defined a pair of openings between the central trunk 66 and each of the front and rear transverse supports 60. These panel openings are designed to accommodate a pair of plywood panels 76 (FIG. 8). Note in the drawings that each plywood panel 76 is supported by the inwardly facing ledge 62 and the inner panel supports 72.

Coupling extension 64 extending outwardly from both forward and rear transverse members 60 forms a connecting surface for the lower edge of front and back side panel assemblies 16 that will be subsequently discussed.

Figure 10:
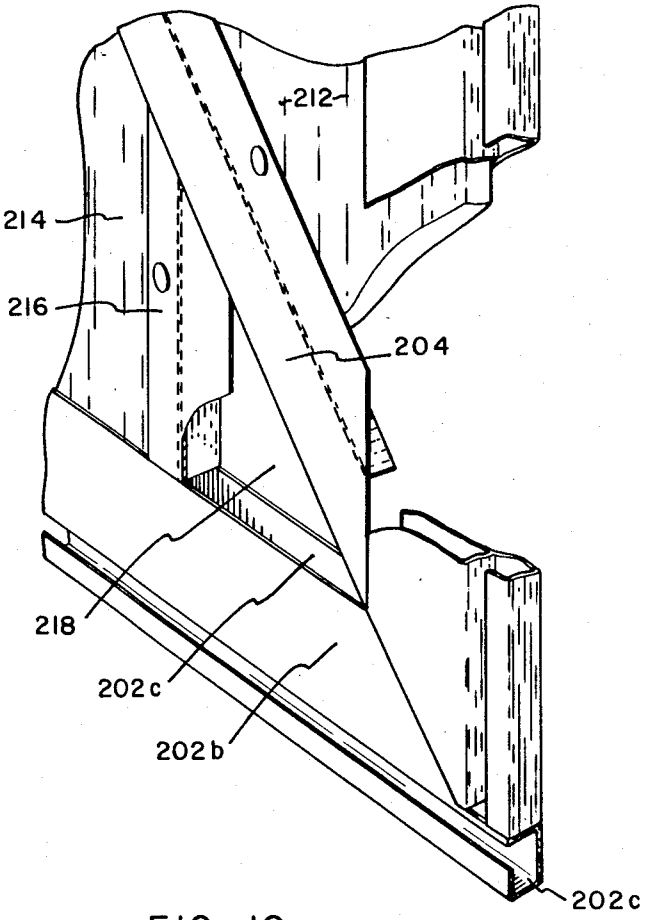
FIG. 10 is a perspective fragmentary view of a corner area of a particular panel assembly that forms a part of the collapsible container.
Figure 9:
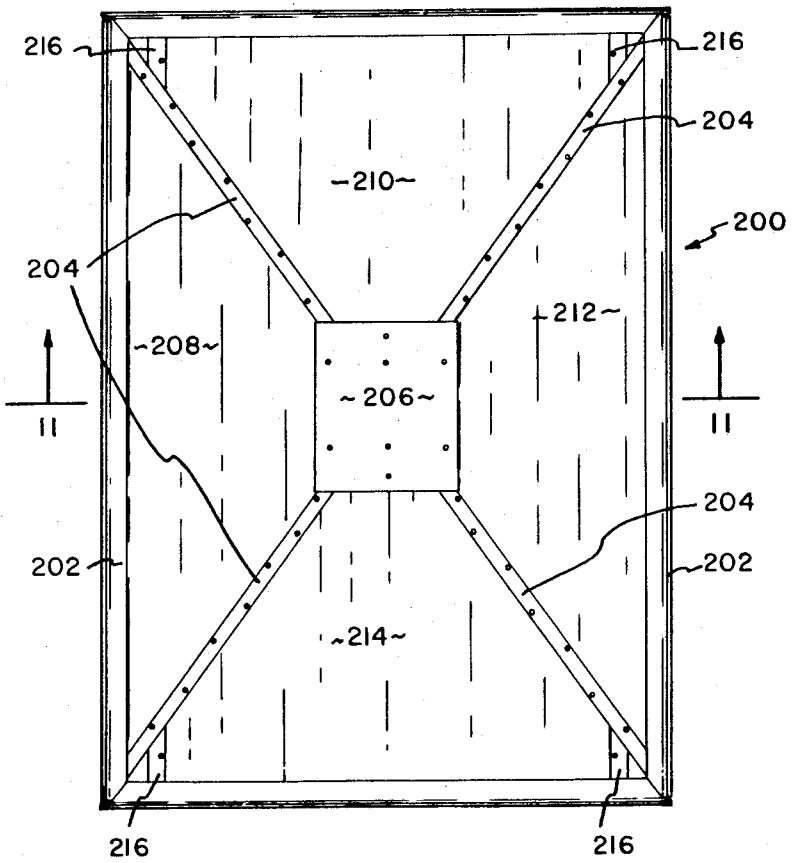
FIG. 9 is a side elevational view of the end panel assembly of the collapsible container of the present invention, as viewed from the outside of the container.
Figure 11:
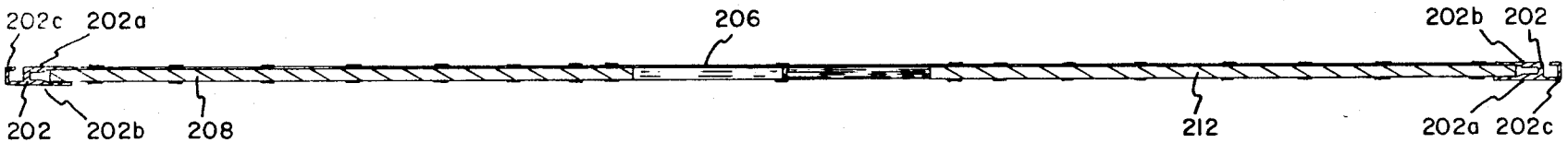
FIG. 11 is a cross sectional view taken along the lines 11—11 of FIG. 9.
Figure 12:
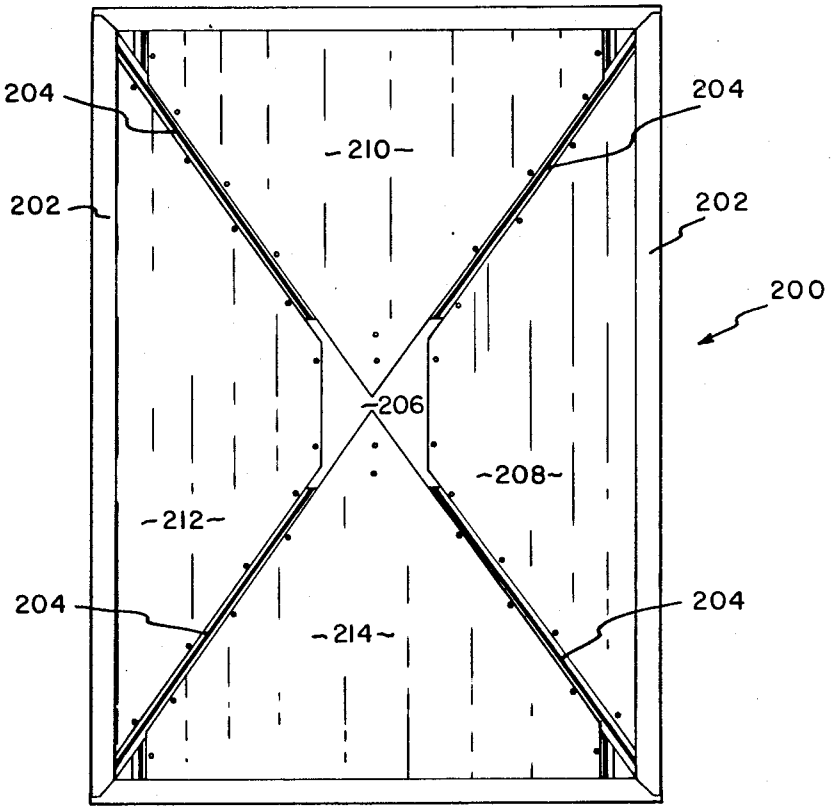
FIG. 12 is a side elevational view of the end panel assembly of the container, viewed from the inside of the container.
Figure 14:
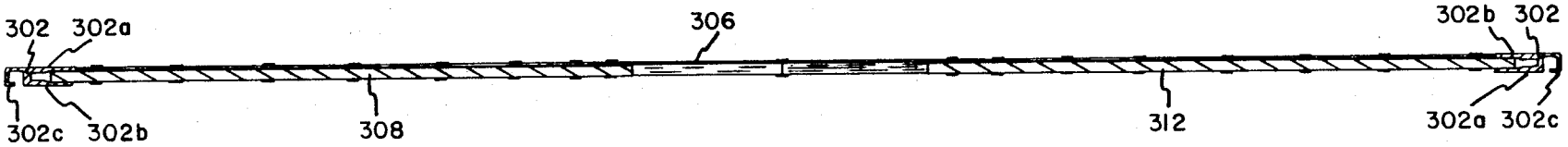
FIG. 14 is a cross sectional view of the top panel assembly taken along the lines 14—14 of FIG. 13.

Connected to opposite ends of the base pallet assembly 12 is a pair of end panel assemblies each indicated generally by the numeral 200 (See FIGS. 9–12). Viewing each end panel assembly 200, it is seen that the same includes a surrounding parameter extrusion 222 that is of the E1 extrusion type. In particular, note that parameter extrusion 202 forming a part of each end assembly 200 includes an outwardly open head section 202*c* and a pair of legs 202*a* and 202*b* that define a space therebetween for receiving inner edge portions of plywood panel inserts (FIG. 11).

Secured to the parameter extrusion 202 is a series of four diagonal extrusions 204 of the E2 extrusion type. Diagonal extrusions 204 extend inwardly where they are secured by weldment or other suitable means to a center plate 206. Thus, there is defined four open areas around the center plate 206. These four open areas are occupied by four plywood panel inserts 208, 210, 212, and 214. It is seen that the plywood panel inserts are secured between legs 202*a* and 202*b* of the parameter extrusion 202 while innermost edges of the plywood panels are riveted to respective diagonal extrusion 204.

The corner construction of the end panels 200 and the roof panel 300 include a special type of construction because of the particular size of the present container 10 and the desire to cut component plywood panels from a four foot by eight foot sheet of plywood. Note in FIG. 10, a fragmentary perspective view of an end panel assembly 200 is shown. Therein, a relatively short corner flange 216 is provided. Corner flange 216 is of the E2 extrusion type. Corner flange 216 extends from the outer leg 202b of the end panel perimeter 200 upwardly to where it joins adjacent diagonal support member 204. A relatively small opening 218 is defined between the corner flange 216 and the diagonal member 204. This is best seen in FIG. 10.

It should be emphasized that the outer parameter of each end panel assembly 200 is of light weight construction inasmuch as it includes an outwardly open coupling surface that is formed by the coupling head of an E1 type extrusion.

Forming the top of the collapsible container 10 of the present invention is a roof panel indicated generally by the numeral 300. As seen in FIG. 1, roof panel 300 extends and interconnects over the upper edges of the end panel assemblies 200.

Roof panel assembly 300 is of a design and construction very similar to an end panel assembly 200 just described. The principal difference is that the head portion of extrusion E1 in the roof panel assembly 300 is turned opposite from the corresponding extrusion head of the end panel assemblies 200.

Briefly reviewing roof panel assembly 300, it is seen that the same includes a perimeter extrusion 302 of the E1 type. The perimeter extrusion 302 includes a head portion 302*c* and a pair of leg portions 302*a* and 302*b*. As will be appreciated from reviewing the drawings, the leg portions 302*a* and 302*b* serve to receive edge portions of respective plywood panels that form a part of the roof assembly.

Figure 15:
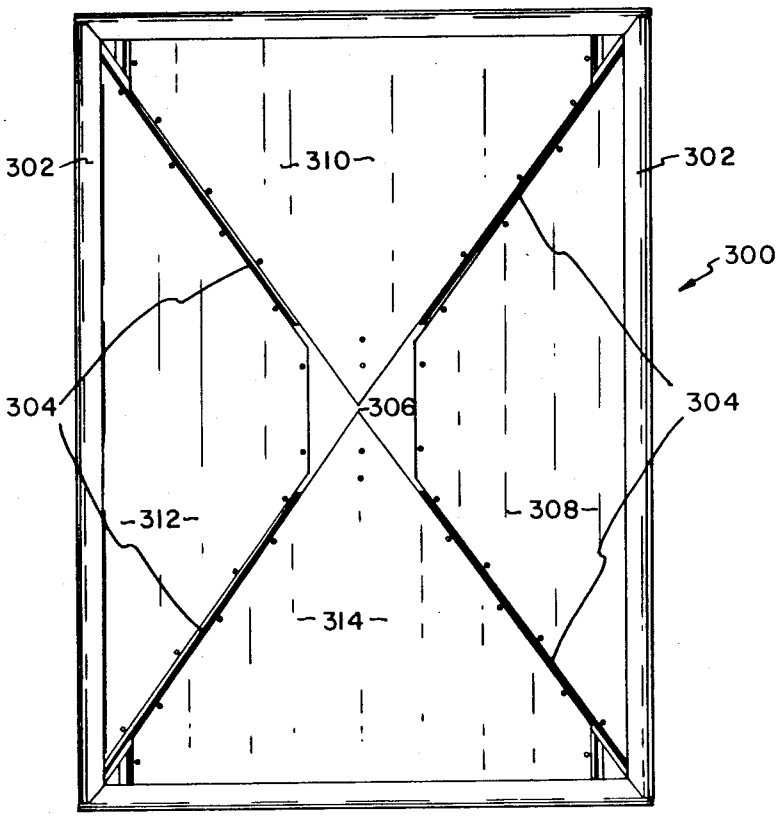
FIG. 15 is a view of the roof panel assembly as viewed from the inside of the container.
Figure 13:
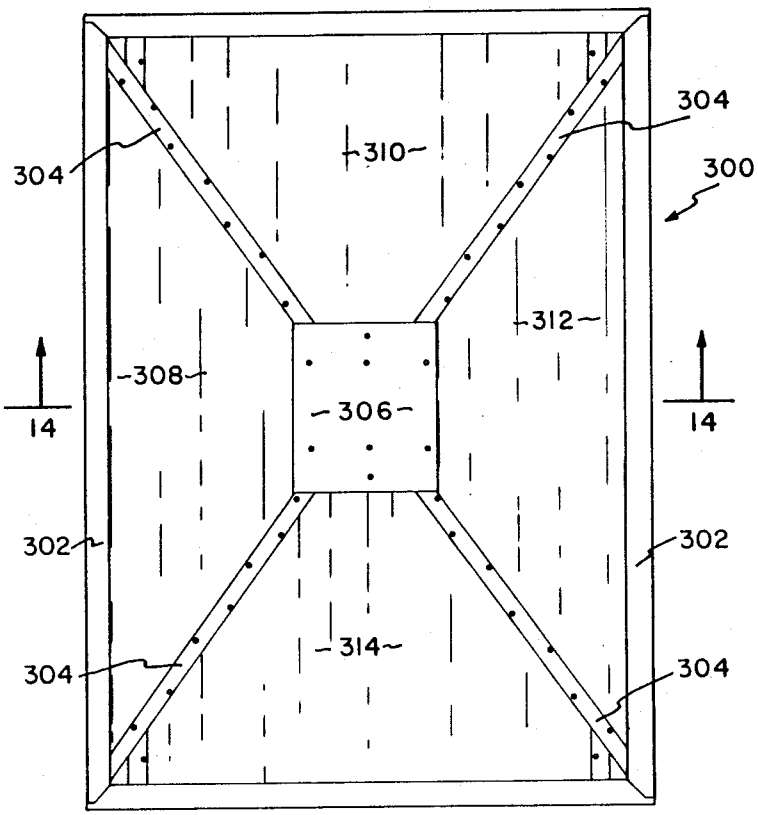
FIG. 13 is a view of the top panel assembly of the container, as viewed from the outside.

As illustrated in FIGS. 13 and 15, there is a series of diagonal extrusions 304, of the E2 type, which extend from respective corners of perimeter extrusion 302 inwardly to where they connect to a center plate 306. The perimeter extrusion 302 along with the diagonal extrusions 304 form four open areas around center plate 306. These openings are filled with four plywood panels 308, 310, 312, and 314. The respective plywood panels are secured along an outer edge within legs 302*a* and 302*b* of the perimeter extrusion 302. Inner edges of the respective plywood panels are riveted along adjacent edges of the diagonal extrusions 304.

Now turning to the side panel assemblies 400, it is seen that the front and back sides of the collapsible container 10 includes side panel assemblies indicated generally by the numeral 400. As will be understood from subsequent portions of this disclosure, the respective front and back side panel assemblies 400 serve to close and seal the collapsible container 10. Viewing the design and construction of a respective side panel assembly 400, it is seen from the drawings that each comprises a series of four separate sub-panel assemblies. These sub-panel assemblies are referred to as a bottom subpanel assembly 400*a*, side sub-panel assemblies 400*b* and 400*c*, and a top sub-panel assembly 400*d*. Except for one minor difference that will be discussed, these sub-panel assemblies are identical in design and construction.

Figure 16:
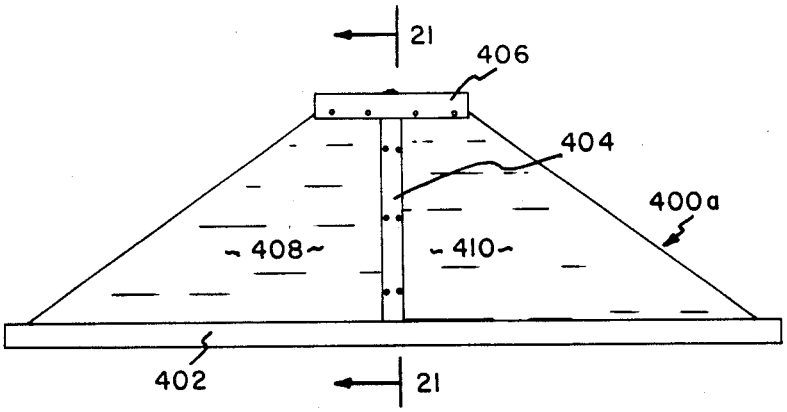
FIG. 16 is a side elevational view of a sub-panel assembly that comprises a part of a side panel assembly of the container.
Figure 17:
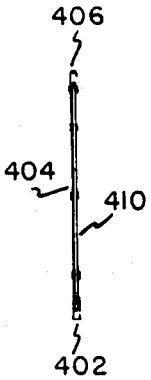
FIG. 17 is an end view of the sub-panel assembly shown in FIG. 16.
Figure 18:
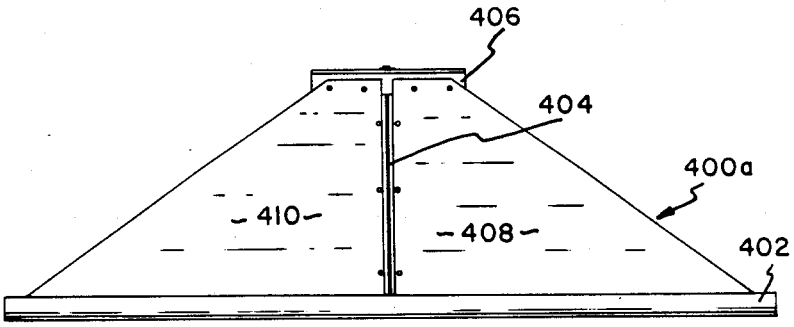
FIG. 18 is an elevational view of the sub-panel assembly shown in FIG. 16, as viewed from the opposite side.
Figure 19:
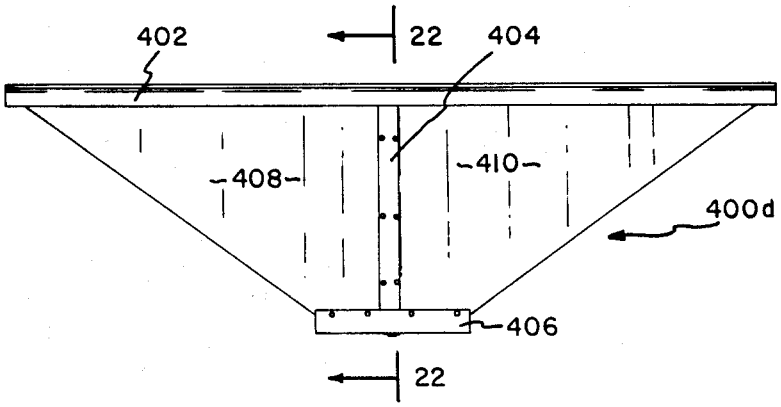
FIG. 19 is an elevational view of a second sub-panel assembly that forms a part of the side panel assembly that encloses one side of the container when the container assumes an erect posture.
Figure 20:
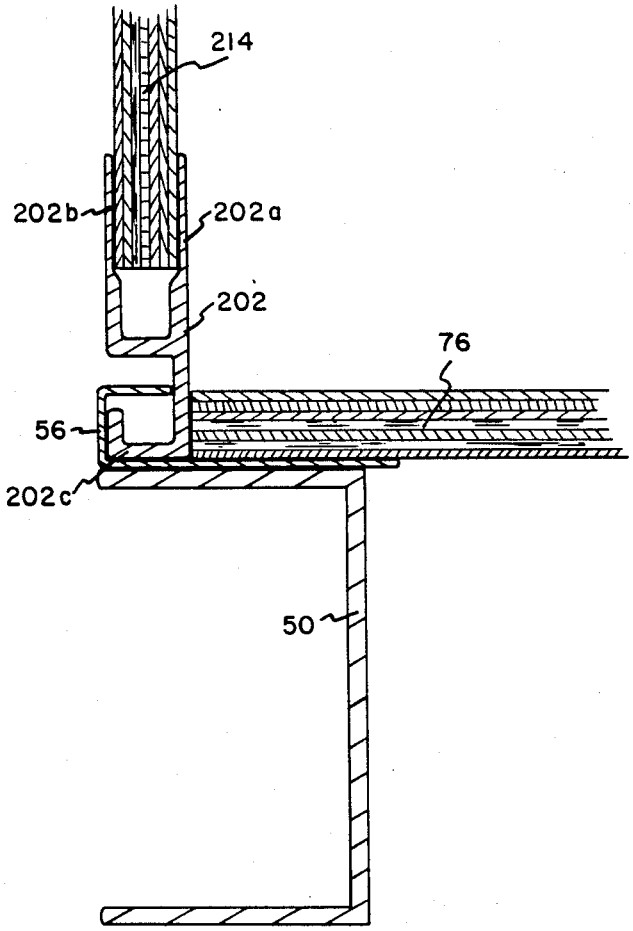
FIG. 20 is fragmentary sectional view showing the interconnection between the bottom pallet assembly and an end panel assembly.
Figure 21:
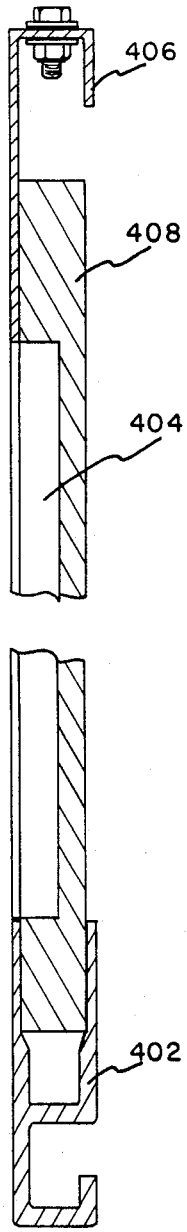
FIG. 21 is a sectional view taken along the lines 21—21 of FIG. 16.
Figure 22:
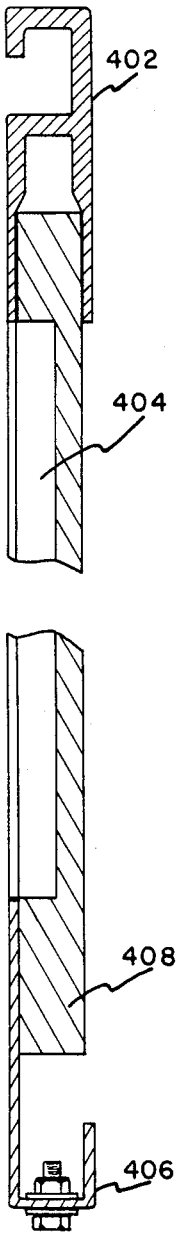
FIG. 22 is a sectional view taken along the lines 22—22 of FIG. 19.

Viewing the respective sub-panel assemblies 400*a*, 400*b*, 400*c*, and 400*d*, it is seen that each includes an elongated perimeter connecting flange 402 of the E1 extrusion type. Being of the E1 extrusion type, the perimeter flange 402 includes a head portion 402*c* and a pair of legs 402*a* and 402*b*. Note in FIGS. 16–18 that the head portion 402*c* is turned inwardly for the bottom and side sub-panel assemblies 400*a*, 400*b*, and 400*c*. The head portion 400*c* of the perimeter flange 402 that forms a part of the top sub-panel assembly 400*d* (FIG. 19) is turned outwardly. That is the basic difference between the subpanel assemblies that for the front and back side assemblies 400 of the container.

Continuing to refer to the respective sub-panel assemblies 400*a*, 400*b*, 400*c*, and 400*d*, seen includes a radial support member 404 that is of the E2 extrusion type. The radial support members 404 are secured to the perimeter flange 402 and extend inwardly to where they connect at a right angle to an inner support 406 that is of tee E3 extrusion type. Secured about opposite sides of the radial support 404 is a pair of plywood panels 408 ad 410 that fit between legs 402*a* and 402*b* and which are riveted or secured by other suitable means to the radial support 404 and the inner support 406.

Because of the design and construction of the side assemblies 400, it is necessary to provide means for interconnecting the respective sub-assemblies thereof about their inner terminal edges. To accomplish this, there is provided a cable tying and sealing assembly indicated generally by the numeral 500 (See FIG. 24). The function of the cable tying and sealing assembly 500 is to tension and align the respective subpanel assemblies and to effectively seal the collapsible container 10.

Viewing cable tying and sealing assembly 500, it is seen that the same includes an elongated flexible cable 502 that includes an eyelet 504 secured about opposite ends of the cable. Connected to each eyelet is a turn buckle 506.

In use, the cable 502 is threaded along the inner terminal edges of the inner support 406. Because the inner supports 406 are of the E3 extrusion type, it is appreciated that they effectively hold and retain the cable 502. The turn buckles 506 are connected to opposite ends of the inner support 406 depending from the top subpanel assembly 400*d*. Thus, it is appreciated by tighting the turn buckles 506 that the respective sub-panel assemblies 400*a*, 400*b*, 400*c*, and 400*d* are tensioned and aligned, and consequently, the entire side panel assembly 400 is supported about the side of the container 10 by the cable assembly 500.

To seal the side panels 400, the cable assembly 500 is provided with cable tails 508 that extend from the respective eyelets 504. Note that both the cable proper 502 and the cable tails 508 are crimped at the eyelets 504 so that each is fixedly secured thereto. Each turn buckle 506 includes an opening formed therethrough and the respective cable tails 508 are threaded through an adjacent turn buckle 506. After passing through a respective turn buckle 506, the respective cable tails 508 are threaded through an opening in a hanging support 510 (E3 extrusion type). The cable tails 508 are then brought together and are secured in a fixed relationship on the hanging support 510 by a gum label 512. Therefore, it is appreciated that in order to open a respective side panel assembly 400 that the gum label has to be removed or somehow altered. This is because the cable assembly 500 cannot be unfastened except by appropriately turning one or both of the turn buckles 506. That obviously cannot occur when the cable tails 508 extend through the openings within the turn buckles 506 and are sealed by the gum label 512. It is appreciated that a customer, after a container 10 has been filled and closed, can sign the gum label 512 and through that process can be relatively assured that if the cable assembly has been disconnected that he or she will be able to determine such.

It is seen that the side panel assemblies 400 leave some open spaces about these front and back areas of the container 10. These open spaces can be conveniently closed by inserting a piece of cardboard or other suitable material 520 adjacent the inside of these side panel assemblies 400. The cardboard itself can be arranged to be self supporting and can also be supported by furniture and other articles being disposed adjacent thereto.

Figure 23A:
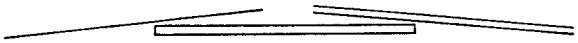
Figure 23B:
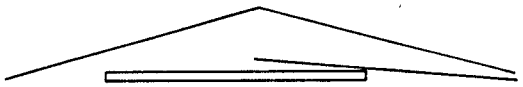
Figure 23C:
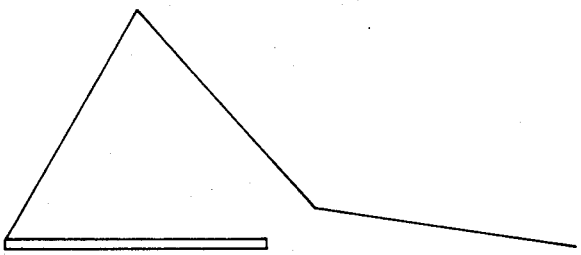
Figure 23D:
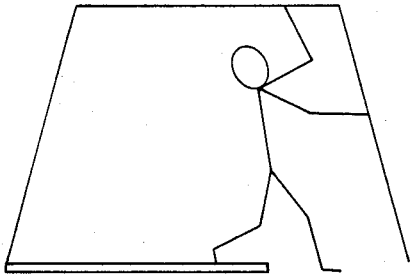
Figure 23E:
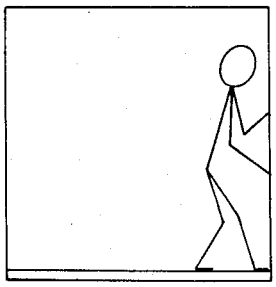

To assemble the collapsible container 10 of the present invention, the following steps and procedures are employed. As illustrated in FIG. 23*a* one start with the bottom pallet assembly 22, the two end panel assemblies 200 and the roof panel assembly 300. First, the upper edge of the left most end panel assembly 200, as viewed in FIG. 23*b*, is connected to the left most edge of the roof panel 300. Next, the lower edge of the left most end panel 200 is inserted into the L-shaped receiver 56 secured to the pallet assembly 12. At the same time, the right most edge of roof panel assembly 300 is connected to the upper edge of the right most end panel assembly 200. See FIG. 23*c*. At this point, the various connections are sufficiently loose to allow an individual to push the two end and roof panels toward the left as viewed in FIG. 23*d*. The lower end of the right most end panel 200 is connected into the L-shaped receiver 56 formed on the right-hand side of the pallet assembly 12, as viewed in FIG. 23*c*. Thus, this completes the erection and connection of the end panels 200 with the roof panel 300 being supported and connected thereover.

Figure 23F:
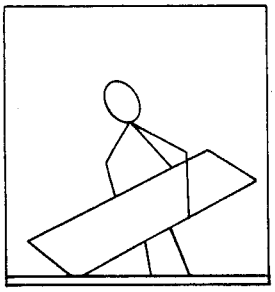
Figure 23G:
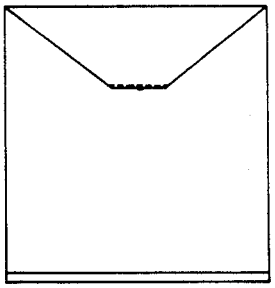
Figure 23H:
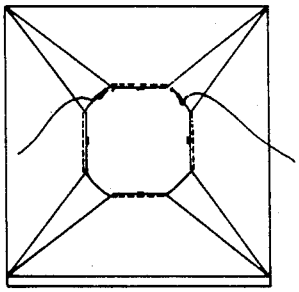
Figure 23I:
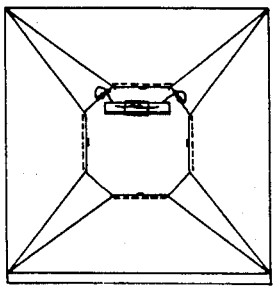

At this time, either of the side panel assemblies 400 are ready for connection. First, the top sub-panel assembly 400*d* is hung from the roof panel assembly 300 (FIGS. 23*f* and 23*g*). Next, the side sub-panel assemblies 400*b* and 400*c* are connected to the side edges of the end panel 200. These side sub-panel assemblies 400*b* and 400*c* are supported and held about the side of the container 10 by a plurality of temporary elastomers interconnected between the respective inner supports 406 of the side sub-panel assemblies 400*b* and 400*c*. Next, the bottom sub-panel assembly 400*a* is coupled to the edge of the bottom pallet assembly 12 and is held in place while the cable tying and sealing assembly 500 is connected and threaded around the respective sub-panel assemblies 400*a*, 400*b*, 400*c*, and 400*d*. See FIGS. 23*h*. After the cable 500 has been appropriately threaded and engaged with the inner supports 406, the upper ends of the turn buckles 506 are connected to the inner support 406 of the top sub-panel assembly 400*d*. After that, the turn buckles 506 are tightened. This results in the respective sub-panel assemblies being pulled together and tensioned in the process. Because of the coupling of the respective sub-panel assemblies with the surrounding edges of the pallet assembly 12, end panel assemblies 200, and roof panel assembly 300, it is appreciated that the respective sub-panel assemblies are held in tension across the side of the container 10.

Thereafter, the tail sections 508 of the cable 500 can be threaded through the turn buckles 506 and the ends placed in a sealed condition by gum label 512 or the like. That completes the erection and connection of one side assembly 400. Because the front and back side assemblies 400 are identical in this disclosure, the preceding steps and procedures are employed in the same fashion to erect and connect the opposite side panel 400.

To dismantle or collapse the container 10, the steps uutlined above are simply reversed. Briefly, the side panel assemblies 400 are first disconnected. Thereafter, one end panel 200 is disconnected from the pallet base 12 and thereafter that end panel assembly is disconnected from the roof panel assembly 00, allowing the roof panel assembly to be further disconnected from the other end panel assembly 200.

In a collapsed mode, the respective panel assemblies of the container 10 can b stacked and secured to form a relatively small and compact package.

Therefore, from the foregoing specification and discussion, it is seen that the present invention entails a moving and storage container for furniture that is collapsible and which is specifically designed to be compatible with a fully automated handling system. Because of the nature and design of the container 10, its design lends itself to automatic handling between the warehouse and the truck, within the truck, and between the truck and the customer's residence.

Of particular importance is the security provided in connection with securing in the front and back side panel assemblies 400 about the container 10. A customer can now be reasonably assured that he or she can detect pilfering or other unauthorized intrusions into the container110 once it has been closed and sealed.

The container design of the present invention can be erected to form a relatively large volume of space, especially in relationship to the weight of the container itself. Thus, in terms of its utility and functionality, the container 10 is very efficient and effective.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A collapsible moving and storage container comprising a plurality of separate and detachable panel assemblies with respective panel assemblies including an open lightweight extruded metal frame having a surrounding extruded metal perimeter and interconnected frame means extending between selected portions of the perimeter so as to define a plurality of openings interiorly of the perimeter; a series of filler panels secured within the openings defined within the respective panel assemblies; and relatively lightweight extruded metal connecting means integral with and extending along the perimeter of respective panel assemblies for connecting one whole panel assembly to another; the integral extruded connecting mans including a pair of cooperating interlocking members that are integral with and project from the extruded metal perimeter of respective panel assemblies and wherein the pair of cooperating integral interlocking members are shaped such that they may be selectively interlocked to form a locked joint that extends along the perimeter of respective joined panel assemblies, and wherein one panel assembly can be disconnected from another by removing one interlocking member from another; at least one panel assembly including a plurality of sub-panel assemblies and wherein there is provided extruded connecting means associated with the sub-panel assemblies that enable the same to be connected to perimeter portions of adjacent panel assemblies to close the container about the side area where the sub-panel assemblies are suspended; and wherein the panel assemblies can be connected in such a fashion that whole panel assemblies can be connected together and erected in a fashion to form a multi-sided container and wherein the extruded connecting means enable the respective whole panels to be quickly and easily connected and disconnected with respect to each other.

2. The collapsible moving and storage container of claim 1 wherein said extruded metal connecting means include a first extrusion having a coupling head and a pair of spaced apart legs extending therefrom that define a filler panel receiving space there between for receiving a filler panel.

3. The moving and storage container of claim 2 wherein said extruded metal connecting means include a second generally L-shaped extrusion that is designed to connect with the coupling head of, the first extrusion in order that pair of panel assemblies having the first and second extrusions may be connected together.

4. The collapsible moving and storage container of claim 3 wherein including a third extrusion that has a cross section that assumes a generally T-shape.

5. The collapsible moving and storage container of claim 1 wherein the interconnecting means of respective panel assemblies include a series of diagonal members that extend inwardly from corner portions of the perimeter; and wherein there is provided a center plate disposed about the center of respective panel assemblies for connecting to the inwardly extending diagonal members.

6. The collapsible moving and storage container of claim 1 including cable assembly means for engaging the sub-panel assemblies and drawing the same inwardly towards each other so as to suspend the sub-panel assemblies about one side of the container.

7. The collapsible moving and storage container of claim 6 including cable assembly means for engaging the sub-panel assemblies and drawing the same inwardly towards each other so as to suspend the sub-panel assemblies about one side of the container.

8. The collapsible moving and storage container of claim 7 wherein said cable assembly means include an elongated cable with two turn buckles attached to opposite ends of the cable, and wherein the sea structure includes a pair of cable tails that extend from the cable through openings provided in the turn buckle and wherein respective free end portions of the cable tails are sealed thereby preventing the turn buckles from being adjusted without rupturing the seal.

9. The collapsible moving and storage container of claim 8 wherein one panel assembly comprises four sub-panel assemblies and wherein each sub-panel assembly includes an inner frame member that is adapted to be engaged by the cable and wherein the cable assembly functions to draw the respective sub-panel assemblies inwardly to form a panel assembly about one side of the container.

10. The collapsible moving and storage container of claim 1 wherein the respective panel assemblies include one bottom pallet panel assembly, two end panel assemblies, one roof panel assembly, and two side panel assemblies.

11. The collapsible moving and storage container of claim 10 wherein the side and roof panel assemblies are substantially similar in size and design.

12. The collapsible moving and storage container of claim 11 wherein the end and roof panel assemblies each include the surrounding perimeter and wherein the interconnecting frame means for the end and roof panels include four diagonal members that extend inwardly from corner portions of the perimeter of each panel and wherein there is provided a center plate connected to the four diagonal members.

13. The collapsible moving and storage container of claim 12 wherein at least one of the side panel assemblies include a series of sub-panel assemblies and suspending means for suspending the respective sub-panel assemblies about one side area of the container for enclosing that area.

14. The collapsible moving and storage container of claim 10 wherein said bottom pallet panel assembly includes a base portion and a plurality of elongated transverse members extending across said base and defining at least two open areas there between, and wherein there is provided panel means for being disposed between the transverse members so as to form a floor area for the container.

15. An enclosable and collapsible moving and storage container that can be quickly erected and dissembled comprising: a bottom panel assembly; two end panel assemblies; a roof panel assembly; front and back side panel assemblies; each panel assembly including an extruded perimeter frame that encloses the panel assembly and forms a single panel unit; the extruded perimeter frame of each panel assembly including a integral extruded connecting means that project from the perimeter frame substantially around the entire panel assembly for connecting each respective panel assembly to a plurality of the panel assemblies via the extruded perimeter frame and connecting means thereof; the integral extruded connecting means including a pair of cooperating interlocking members that are integral with and project form the extruded metal perimeter of respective panel assemblies and wherein the pair of cooperating integral interlocking members are shaped such that they may be selectively interlocked to form a locked joint that extends along the perimeter of respective joined panel assemblies, and wherein one panel assembly can be disconnected from another by removing one interlocking member from another; at least one of said front and back side panel assemblies comprising a series of sub-panel assemblies designed to be attached about a side area of the container for enclosing that area of the same and wherein the panel assemblies can be connected and disconnected quickly and easily by joining and disjoining the interlocking members that form a part of the perimeter of the panel assemblies; and wherein certain panel assemblies include an open frame structure that includes a series of openings formed therein and a series of filler panels secured within the defined openings.

16. The collapsible moving and storage container of claim 17 wherein said extruded metal connecting means includes a connecting head portion and a pair of spaced apart legs extending therefrom with said legs defining a space there between for receiving the filler panels forming a part of certain panel assemblies.

17. The collapsible moving and storage container of claim 15 wherein at least one of said front and back side panel assemblies comprising a series of sub-panel assemblies designed to be attached about a side area of the container for enclosing that area of the same.

18. The collapsible moving and storage container of claim 17 wherein there is provided a cable assembly for interconnecting respective sub-panel assemblies having inner and outer eedge portions and wherein the sub-panel assemblies are designed such that connect with adjacent panel assemblies about the outer edge portion while their inner edge portion is designed to be engaged by the cable assembly which functions to tension the respective sub-panel assemblies by drawing them inwardly towards each other so as to suspend the respective sub-panel assemblies about a side area of the container.

19. A collapsible moving and storage container adapted to the readily assembled into an erect posture and easily disassembled for convenient storage and transport comprising:

a. a bottom pallet panel assembly including a base, a series of at least three members extending transversely across the base and secured thereto and defining at least two openings between the respective members; and at least two filler panels disposed in the openings formed by the three transversely extending members and wherein the filler panels along with the transverse members form a floor area for the collapsible container;

b. extruded metal connecting means formed around substantially the entire perimeter of the bottom pallet assembly;

c. a pair of like end panel assemblies adapted to be connected to the bottom panel assembly about opposite ends thereof, each end panel assembly including a metal perimeter frame structure and an inner diagonal frame structure that extends inwardly from the perimeter frame structure and defines a series of openings in the end panel, and a series of filler panels secured within the openings defined by the perimeter and diagonal frame structure of each respective end panel assembly;

d. the perimeter frame structure of each end panel assembly including extruded metal connecting means formed substantially around the entire perimeter thereof;

e. and wherein the extruded metal connecting means of each end panel assembly is designed to couple and connect with the extruded metal connecting means formed about the perimeter of the bottom pallet panel assembly such that each end panel assembly can be connected at a right angle thereto;

f. a roof panel assembly adapted to the connected to the top portion of the two end panel assemblies, the roof panel assembly including a metal perimeter frame structure and an inner diagonal frame structure that extends inwardly from the perimeter frame structure and defines a series of openings in the roof panel, and a series of filler panels secured within the openings defined by the perimeter and diagonal frame structure of the roof panel;

g. the perimeter frame structure of the roof panel assembly including extruded metal connecting means formed substantially around the entire perimeter of the roof panel;

h. and wherein the extruded metal connecting means of the roof panel assembly is designed to mate and couple with the extruded metal connecting means formed about the perimeter of the end panel assemblies such that the roof panel assembly can be readily detachably connected to the end panel assemblies;

i. a pair of side panel assemblies adapted to be connected to the bottom pallet panel assembly, the end panel assemblies, and the roof panel assembly so as to form a box type closure;

j. at least one of said side panel assemblies including a plurality of sub-panel assemblies including an upper sub-panel assembly, a lower sub-panel assembly, and a pair of opposed side sub-panel assemblies; and k. each sub-panel assembly including an outer and inner perimeter frame structure and wherein the outer perimeter frame structure of each sub-panel assembly includes extruded metal connecting means that allow the respective sub-panel assembly to be connected to an adjacent panel assembly;

l. a cable assembly for engaging the series of sub-panel assemblies and suspending the same about one side of the container in order to at least partiall close the container, the cable assembly including an elongated flexible cable that extends around and engages each sub-panel assembly and wherein there is provided cable tensioning means for tensioning the same and drawing the respective sub-panel assemblies inwardly so as to suspend the respective sub-panel assemblies about one side of the container in such a fashion that the cable assembly pulls the respective sub-panel assemblies inwardly while the outer perimeter frame members of the sub-panel assemblies are connected to adjacent panel assemblies.

20. The collapsible moving and storage container of claim 19 wherein said cable assembly includes a seal structure for sealing the cable assembly in a taut and closed position in such a fashion that the side panel assembly comprised of the series of sub-panel assemblies..cannot be entered without disturbing the seal structure.

21. A collapsible moving and storage container comprising a plurality of separate and detachable panel assemblies with respective panel assemblies including an open lightweight extruded metal frame having a surrounding extruded metal perimeter and interconnecting frame means extending between selected portions of the perimeter so as to define a plurality of openings interiorly of the perimeter; a series of filler panels secured within the openings defined within the respective panel assemblies; and relatively lightweight extruded metal connecting means integral with and extending along the perimeter of respective panel assemblies for connecting one whole panel assembly to another; the integral extruded connecting means including a pair of cooperating interlocking members that are integral with and project from the extruded metal perimeter of respective panel assemblies and wherein the pair of cooperating integral interlocking members are shaped such that they may be selectively interlocked to form a locked joint that extends along the perimeter of respective joined panel assemblies, and wherein one panel assembly can be disconnected from another by removing one interlocking members from another; the interconnecting means of respective panel assemblies including a series of diagonal members that extend inwardly from corner portions of the perimeter; a center plate disposed about the center of respective panel assemblies for connecting to the inwardly extending diagonal members; and wherein the panel assesmblies can be connected in such a fashion that whole panel assemblies can be connected together and erected in a fashion to form a multi-sided container and wherein the extruded connecting means enable the respective whole panels to be quickly and easily connected and disconnected with respect to each other.

* * * * *